United States Patent [19]

Perez

[11] Patent Number: 4,586,483

[45] Date of Patent: May 6, 1986

[54] ADJUSTABLE DUAL VENTURI ASSEMBLY

[76] Inventor: Manuel Perez, 11204 Hidden Valley, Tampa, Fla. 33624

[21] Appl. No.: 626,224

[22] Filed: Jun. 29, 1984

[51] Int. Cl.[4] ..... F24C 3/04

[52] U.S. Cl. ..... 126/41 R; 431/354; 48/180 F

[58] Field of Search ..... 126/41 R

[56] References Cited

U.S. PATENT DOCUMENTS 4,373,505 2/1983 Koziol ..... 126/41 R
4,485,799 12/1984 Perez ..... 126/41 R
4,488,534 12/1984 Koziol ..... 126/41 R

*Primary Examiner*—Carroll B. Dority, Jr.
*Attorney, Agent, or Firm*—A. W. Fisher, III

[57] ABSTRACT

An adjustable dual mixing assembly specifically configured for use with a dual burner gas grill including a burner element having a pair of gas supply tubes affixed thereto in spaced relationship relative to each other and a pair of corresponding gas supply nozzles in spaced relationship relative to each other and to the pair of gas supply tubes, the adjustable dual mixing assembly comprising a pair of mixing tubes corresponding to the pair of gas supply tubes and the pair of gas supply nozzles, each mixing tube comprising an inner substantially cylindrical base member telescopingly and rotatably disposed within the corresponding gas supply tubes and an outer arcuate gas supply member corresponding to the pair of gas supply nozzles and a securing device including a first locking element attached to each of the two mixing tubes and a second locking element attached to each of the gas supply tubes such that each of the two mixing tubes may be adjusted longitudinally and laterally between corresponding gas supply tubes and gas supply nozzles permitting one of the predetermined first locking elements to engage a corresponding second locking element to secure the corresponding mixing tube to the gas supply tube in operative relationship with the corresponding gas supply nozzle.

1 Claim, 5 Drawing Figures

FIG. 1
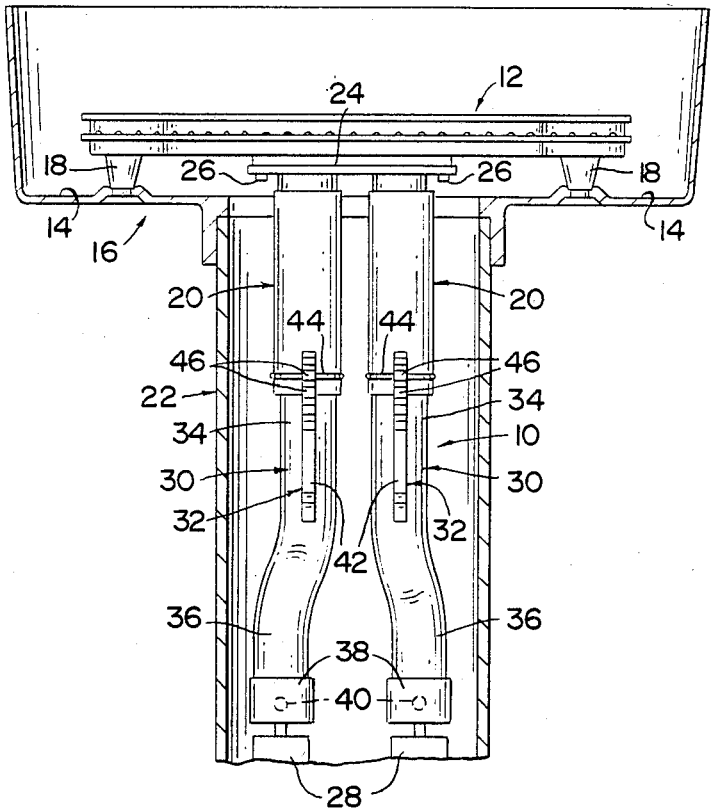
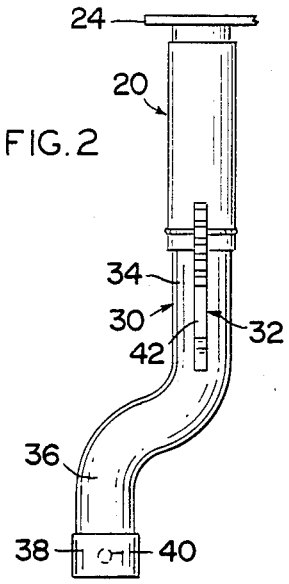
FIG. 2
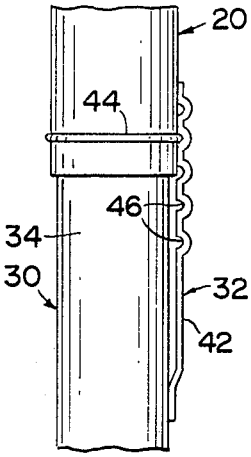
FIG. 3
FIG. 4
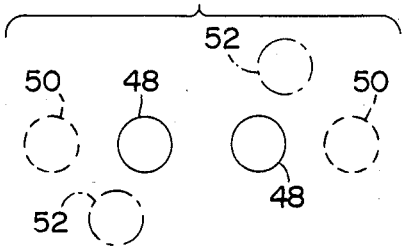
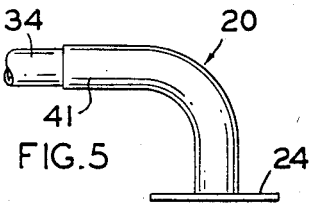
FIG. 5

ADJUSTABLE DUAL VENTURI ASSEMBLY

BACKGROUND OF THE INVENTION

1. Field of the Invention

An adjustable dual mixing assembly specifically configured for use with a dual burner gas grill including a burner element having a pair of gas supply tubes affixed thereto and a pair of corresponding gas supply nozzles in spaced relationship relative to the pair of gas supply tubes.

2. Description of the Prior Art

A number of different designs and configurations for gas grills have been developed. Gas grills are often arranged to uniformally heat over the entire area of the grill enclosure. This is desirable when each piece of food or all portions of a large portion of food will receive an equal amount of heat rendering it unnecessary to shift the pieces or piece during cooking. Unfortunately in larger grills, there may be a need to operate different areas on the grill at different temperatures. To accomplish this, various split or dual gas burners have been developed. Such grills include a pair of gas supply tubes in spaced relation relative to a corresponding pair of gas supply nozzles. The longitudinal separation between the gas supply tubes and gas supply nozzles may vary from 4 to 7 inches between grills while the lateral separation between the pair of gas supply nozzles may vary from 1¼ to 3 inches. Moreover, the positioning of the pair of gas supply nozzles relative to the burner itself may vary. Examples of such prior art are disclosed in U.S. Pat. Nos. 3,638,635 and 4,092,975.

In addition, various attempts have been undertaken to provide a universal burner element for gas grills to accommodate gas grills of various sizes. In order to provide this, such structures have included adjustable and telescoping gas intake/venturi tube assemblies for the gas grill. An example of such prior art is disclosed in U.S. Pat. No. 4,267,816.

Additional examples of prior art are shown in U.S. Pat. Nos. 4,356,810 and 4,373,505.

Unfortunately when combining a dual or split burner with an adjustable gas intake tube/venturi assembly there is a substantial danger or hazard in not having each of the dual gas intake/venturi assemblies properly seated on the dual gas supply nozzles. Thus there is a significant need for maintaining the dual gas intake/-venturi assemblies in proper alignment relative to each other.

SUMMARY OF THE INVENTION

The present invention relates to an adjustable dual mixing assembly for use with a dual burner gas grill that includes a burner element having a pair of gas supply tubes extending downwardly therefrom. A corresponding pair of gas supply nozzles is disposed in fixed space relationship relative to the pair of gas supply tubes. Since the longitudinally distance between corresponding gas supply tubes and gas supply nozzles and the lateral separation or distance between the gas supply nozzles varies significantly between manufacturers, the adjustable dual mixing assembly is configured to permit adjustment to account for the longitudinal and lateral differences.

The adjustable dual mixing assembly comprises a pair of mixing tubes corresponding to the gas supply tubes and supply nozzles and a securing means to secure the adjustable mixing tubes in longitudinal and lateral position as more fully described hereinafter. The adjustble mixing tubes are telescopingly disposed within the corresponding gas supply tubes. The securing means comprises a pair of securing elements each including a first locking element attached to the corresponding mixing tube and a plurality of apertures formed on the respective or corresponding gas supply tubes.

In operation, the first locking member is moved out of operative locking relationship relative to the corresponding second locking member to permit the mixing tubes to be telescopically and rotatably moved relative to the corresponding gas supply tube in order that the mixing tubes may be adjusted longitudinally and laterally over the corresponding gas supply nozzle to permit fluid communication between a gas source and the burner element.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a view of the adjustble dual mixing assembly in place within a dual burner gas grill.

FIG. 2 is a detailed front view of a mixing tube and gas supply tube.

FIG. 3 is a partial side view of a mixing tube.

FIG. 4 is a schematic end view showing various adjustable positions of the mixing tubes relative to each other.

FIG. 5 is partial side view of an up front control arcuate gas supply tube.

Similar reference characters refer to similar parts throughout the several views of the drawings.

DETAILED DESCRIPTION OF THE PREFERRED EMBODIMENT

As shown in FIG. 1, the present invention relates to an adjustable dual mixing assembly generally indicated as 10 for use with a dual burner gas grill. The dual burner gas grill comprises a burner element generally indicated as 12 is supported in fixed spaced relation relative to the floor 14 of the barbeque grill generally indicated as 16 by a plurality of support members each indicated as 18. A pair of gas supply tubes each indicated as 20 are operatively disposed in a substantially vertical standard or the like indicated as 22 in fixed spaced relationship relative to each other. Each gas supply tube 20 is affixed to a mounting plate 24 which is in turn fastened to the burner element 12 by fasteners 26. Disposed in the lower portion of the substantially vertical standard 22 is a pair of gas supply nozzles each indicated as 28 in fixed spaced relationship relative to each other. Longitudinal distance between corresponding gas supply tubes 20 and the corresponding gas supply nozzle 28 very significantly from dual burner gas grill manufacturers. In addition, the lateral separation or distance between the pair of gas supply nozzles 28 varies significantly between various manufacturers of dual burner gas grills.

The adjustble dual mixing assembly 10 comprises a pair of mixing tubes each generally indicated as 30 corresponding to one of the pair of gas supply tubes 20 and the corresponding gas supply nozzle 28 and a securing means comprising a pair of securing elements each generally indicated as 32 corresponding with one of the pair of mixing tubes 30 and the corresponding gas supply tube 20. As best shown in FIG. 2 each of the mixing tubes 30 comprises an inner substantially cylindrical the inner portion of the arcuate gas supply tube 20 may vary between 2 to 3 inches from manufacturer to manufacturer.

As best shown in FIG. 3, each securing device 32 comprises a first locking element comprising an elongated flexible inter connecting member 42 attached directly to the mixing tube 30 and an annular rib 44 formed on the respective gas supply tube 20. The elongated flexible interconnecting member 42 is attached directly to the mixing tube on the inner substantially cylindrical base member 34 and includes a plurality of recesses or grooves 46 to selectively engage and seat on the annular rib 44.

The operation of the adjustable dual mixing assembly 10 is best understood with reference to FIG. 4. Specifically, the first locking member 42 is moved out of operative locking relationship relative to the second locking member 44 to permit the mixing tubes 30 to be telescopingly rotatably moved relative to the corresponding gas supply tube 20 in order that the mixing tubes 30 may be adjusted to longitudinally and laterally fit over the corresponding gas supply nozzle 28 to permit fluid communication between the gas source (not shown) and the burner element 12. For example, the solid lines 48 in FIG. 4 may show a lateral disposition of the gas supply nozzles 28 relative to each other, each of 1½ inches separation which the phantom lines 50 in lines therewith may show the gas supply nozzles 28 in 4 inches in lateral separation. By rotation of the mixing tubes 30, 90° it is possible to provide this separation. In addition, where there is an offset in the gas supply nozzles 28 as shown in the second phantom lines 52 it is possible to provide lateral adjustment for this base member 34 telescopingly disposed within the corresponding supply tube 20 and an outer arcuate gas supply member 36 including a lower gas supply element having a longitudinal center line offset from the longitudinal center line of the inner substantially cylindrical base member 34 and substantially parallel thereto. An adjustable air regulator 38 is attached to the outer end of the outer arcuate gas supply member 36 to operate in combination with aperture 40 formed in the outer portion of the outer arcuate gas supply member 36 to control the vacuum generated through the respective mixing tubes 30. As described more fully hereinafter, the telescoping relationship between the gas supply tube 20 and the corresponding mixing tube 30 permit adjustment for the various longitudinal separations between the gas supply tube 20 and the gas supply nozzle 28 from various manufacturers while the outer arcuate gas supply member 36 permits virtual lateral adjustment of the individual mixing tubes 30 relative to the corresponding gas supply nozzle 28 by rotation of the individual mixing tubes 30 to accommodate variations in the lateral separation of the gas supply nozzles 28 from various manufacturers. As disclosed, the dual burner gas grill comprises an in post control unit while it is envisioned that the up front control type dual burner gas grill may be accommodated with the same adjustable dual mixing assembly 10. Up front control type dual burner gas grills include an arcuate gas supply tube 20 extending between the mounting plate 24 and mixing tube 30 thus requiring adjustment in a dimension. As shown in FIG. 5, the inner portion 41 of the arcuate gas supply tube 20 that receives the corresponding mixing tube 30 is substantially parallel to the mounting plate 24. The lateral or spaced relation between the mounting plate 24 and dimension. In addition, by the vertical movement to the telescoping relationship between the mixing tube 30 and their respective or corresponding gas supply tube 20, the longitudinal dimension or separation between the gas supply tube 20 and the gas supply nozzle 28 may be accommodated. Once in position, the mixing tubes 30 by virtue of the resilience of the elongated flexible interconnecting member 42 permits release thereof causing the annular rib 44 to operatively engage the appropriate recess 44 to secure the mixing tube 30 in longitudinal and rotational position relative to the corresponding gas supply tube 20.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. An adjustable dual mixing assembly specifically configured for use with a dual burner gas grill including a burner element having a pair of gas supply tubes affixed thereto and a pair of corresponding gas supply nozzles in spaced relationship to the pair of gas supply tubes, said adjustable dual mixing assembly comprising a pair of mixing tubes corresponding to the pair of gas supply tubes and gas supply nozzles, each said mixing tube comprising an inner base member and an arcuate gas supply member including a lower gas supply element having a longitudinal center line offset from the center line of said inner base member and substantially parallel thereto, each said mixing tube being telescopingly and rotatably disposed within the corresponding gas supply tube to permit longitudinal and lateral adjustment of each said lower gas supply element relative to the corresponding gas supply nozzle; said adjustable dual mixing assembly further including a securing means having a securing device corresponding to each of said mixing tubes, each said securing device including an elongated flexible interconnecting member movable between a first and second position including a plurality of grooves formed thereon attached to each of said corresponding mixing tubes to permit longitudinal movement of each said lower gas supply element relative to the corresponding gas supply nozzle when in said second position and an annular rib formed on each said corresponding gas supply tube, each said annular rib being disposed to selectively receive one of said grooves of said corresponding elongated flexible interconnecting member to secure said mixing tube longitudinal when in said first position and permits rotational movement of said mixing tube relative to the corresponding gas supply tube.

* * * * *